United States Patent [19]

Khoury

[11] 4,043,479

[45] Aug. 23, 1977

[54] FRONT OPENING EASY-OPENING END CLOSURE WITH VENT

[75] Inventor: Nick S. Khoury, Worth, Ill.

[73] Assignee: The Continental Group, Inc., New York, N.Y.

[21] Appl. No.: 734,579

[22] Filed: Oct. 21, 1976

Related U.S. Application Data

[63] Continuation of Ser. No. 684,591, May 10, 1976, abandoned.

[51] Int. Cl.[2] ..... B65D 41/32

[52] U.S. Cl. ..... 220/271

[58] Field of Search ..... 220/231, 267, 269–273

[56] References Cited

U.S. PATENT DOCUMENTS

| | | | |
|---|---|---|---|
| 3,593,875 | 7/1971 | Fraze | 220/271 |
| 3,618,815 | 11/1971 | Heffner | 220/269 |

*Primary Examiner*—George T. Hall

*Attorney, Agent, or Firm*—John J. Kowalik; Joseph E. Kerwin; William A. Dittmann

[57] ABSTRACT

An improved front opening easy-open end closure wherein the opening flap is formed with an auxiliary score line rupturable to form a vent opening, and the pull tab is provided with an auxiliary rupturing member comprising a panelwardly directed protrusion, superposed in relation to the auxiliary score line and arranged such that displacement of the tab to open the flap results in prior rupture of the auxiliary score line and venting of the container.

8 Claims, 6 Drawing Figures

FRONT OPENING EASY-OPENING END CLOSURE WITH VENT

This is a continuation of Ser. No. 684,591, filed May 10, 1976 now abandoned.

SUMMARY OF THE INVENTION

The present invention relates to container end closures and, more particularly, to easy-opening closures for pressurized containers.

It is often necessary or desirable to form a vent opening in an easy-opening end closure to release or admit pressure in such packed containers before the initial rupture of the flap-defining score line.

Heretofore, such vent openings have been formed only with rear opening tabs, i.e., those tabs that are secured to a tear strip intermediate the ends of the tab and wherein the intermediate portion of the tab lifts the leading edge of the tear strip to initiate severance thereof. One such device includes a complicated hinged tab arrangement secured to a tear strip in an end panel by a first rivet and is further secured to the end panel by a vent rivet which is spaced from the first rivet and lies outside of the tear strip. When the tab is manipulated to open the container, the vent rivet is removed by a shearing action before the tab is operative to remove the tear strip from the end panel. This arrangement is fraught with disadvantages, among which are the complexity of the tab, the need for a second rivet, and the additional force required to remove the vent rivet by a shearing action. Furthermore, this prior art device would not be suited for use with a front opening tab.

It is therefore the primary object of the present invention to provide an improved front opening easy-open container end closure wherein the container is vented to atmospheric pressure prior to initial rupture of the flap-defining score line.

It is another object to provide a self-venting easy-opening end closure which may be produced with minimal modification of existing tooling.

BRIEF DESCRIPTION OF THE DRAWINGS

The various features and advantages of the end closure of the present invention will be more readily apparent from the following detailed description when considered in connection with the accompanying drawing wherein.

DESCRIPTION OF THE PREFERRED EMBODIMENT

Figure 1:
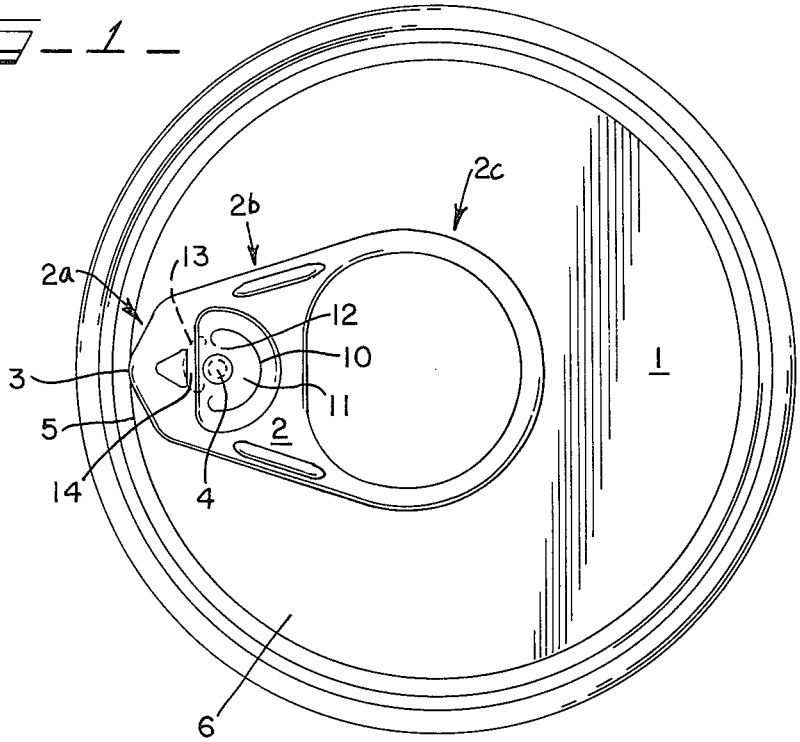
FIG. 1 is a top plan view of one embodiment of the present invention.

As shown in the drawings, the closure of this invention includes an end panel 1, a pull tab 2 comprising a nose portion **2*a*, an intermediate portion 2*b* and a grasping portion 2*c*, an integral rupturing member 3 formed in the nose portion 2*a*, a rivet 4 fastening the pull tab 2 intermediate its ends to the end panel 1, and a score line 5 formed in the end panel 1 and therein defining an opening flap 6**.

A substantially horseshoe-shaped slit 10 is formed in the intermediate portion **2*b*, embracing the rivet 4 and defining a rivet panel 11 in said portion 2*b*. The rivet panel 11 is joined to the remainder of the intermediate portion 2*c* of the tab 2 by an unslit area 12**.

An auxiliary score line 13 is formed in the flap 6, between the score line 5 and the rivet 4, and therein defines a vent flap 14, with an unscored section 15 of the vent perimeter serving as an integral hinge nonremovably attaching the vent flap 14 to the remainder of the flap 6.

Figure 2:
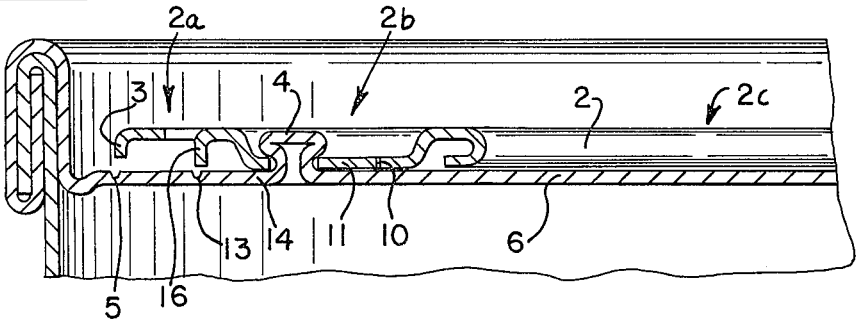
FIG. 2 is a fragmentary cross-sectional view taken substantially along line 2—2 of FIG. 1, illustrating the closure in the closed condition.
Figure 3:
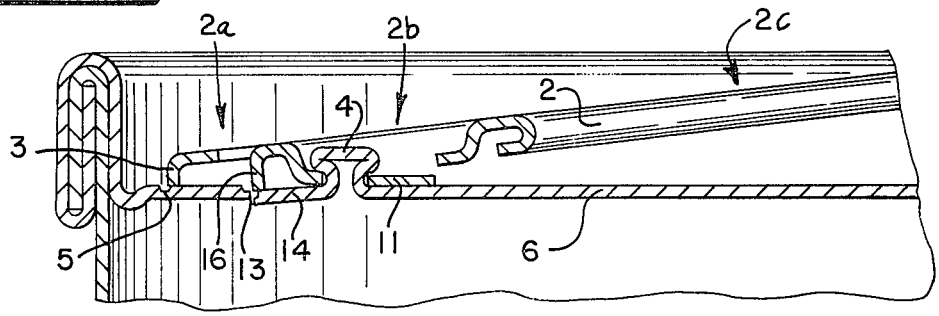
FIG. 3 is a fragmentary cross-sectional view similar to FIG. 2, illustrating the closure with the vent opened.

An auxiliary rupturing member 16, comprising a panelward projection formed in the nose portion **2*a* of the tab 2 is positioned above the vent flap 14 and proximate the auxiliary score line 13. As best shown in FIG. 2, the auxiliary rupturing member 16 may be formed as a tongue of material displaced from the principal plane of the tab 2. Alternatively, the member 16 may be formed as a bead or protrusion as illustrated in FIG. 5**.

Optionally, a raised projection 17 may be formed on the vent 14, to cooperate with the auxiliary rupturing member 16.

To open the closure, the grasping portion **2*c* of the tab 2 is lifted, causing the tab 2 to pivot about the hinge 12 and urging the nose portion 2*a* panelwardly. As the nose portion 2*a* rotates downwardly, the auxiliary rupturing member 16 contacts the vent flap 14 or vent projection 17 and impresses a downward force thereon, stressing the end panel 1 in the region of the auxiliary score line 13 and, ultimately, rupturing the score 13 and opening the vent. Further lifting of the grasping portion results in rupture of the score line 5** and controlled tearing therealong in the manner of conventional easy opening end closures.

Figure 4:
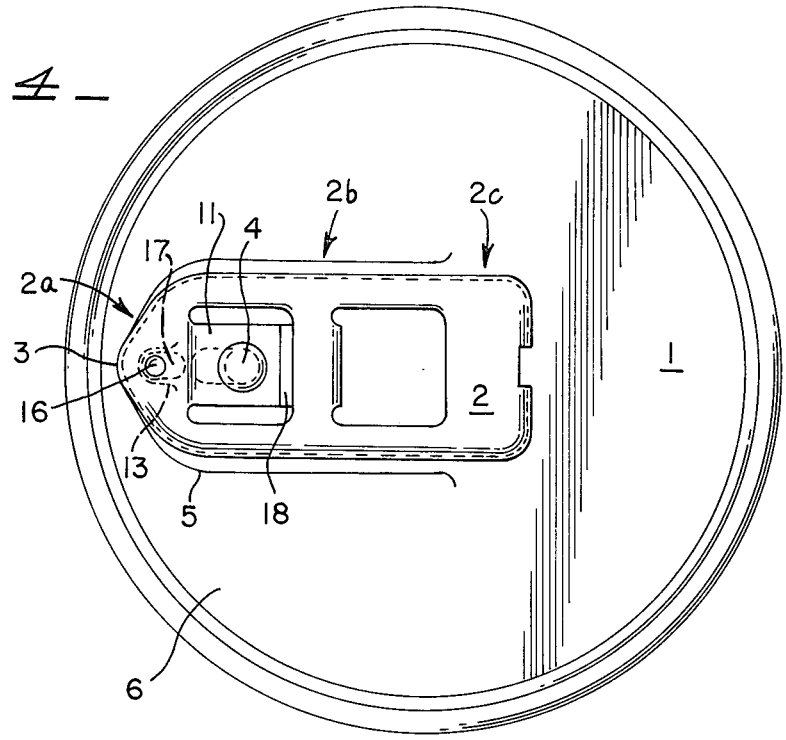
FIG. 4 is a top plan view of a second embodiment of the present invention.
Figure 5:
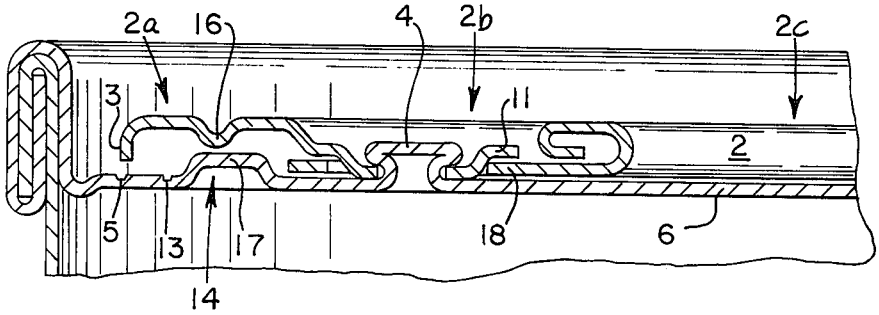
FIG. 5 is a fragmentary cross-sectional view taken substantially along line 5—5 of FIG. 4, illustrating the closure in the closed condition.
Figure 6:
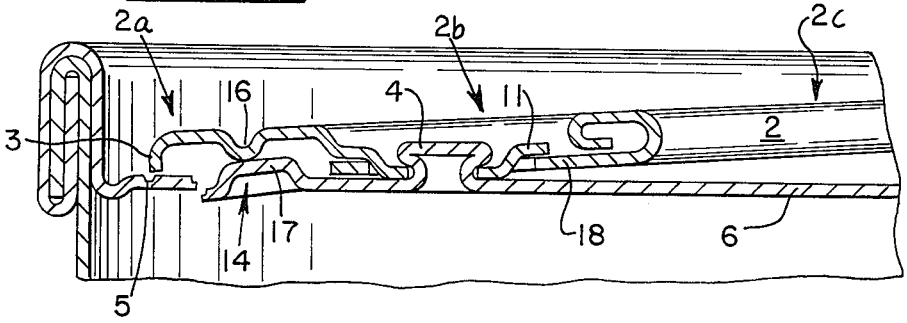
FIG. 6 is a fragmentary cross-sectional view similar to FIG. 5, illustrating the closure with the vent opened.

It is to be noted that the present invention, as illustrated in FIGS. 4–6, contemplates optional use of an integrally formed tab retention member 18 to limit displacement of the tab 2 relative to the flap 6. The retention member 18 is more fully described in the U.S. copending application Ser. No. 684,620 NON-OBSTRUCTING END CLOSURE - filed concurrently herewith.

I claim:

1. An improved easy-open end closure of the type comprising an end panel with a score line defining an opening flap therein, and a pull tab non-removably attached to said end panel and having rupturing means for rupturing said score line consequent to a predetermined displacement of said pull tab to open said closure, the improvement comprising: an auxiliary score line formed in said opening flap and rupturable to form a vent opening therein, and panelwardly directed auxiliary rupturing means on said pull tab for rupturing said auxiliary score line consequent to displacement of said pull tab to open said closure, said auxiliary score line being rupturable prior to rupture of said score line.

2. The invention according to claim 1, wherein said pull tab comprises a nose portion and a grasping portion and said auxiliary score line underlies said nose portion.

3. The invention according to claim 2, wherein said auxiliary rupturing means comprises a projection formed on said nose portion of said pull tab.

4. The invention according to claim 3, wherein said flap is formed with a raised projection underlying said panelward projection on said pull tab.

5. The invention according to claim 3, wherein said panelward projection on said pull tab comprises a tongue of material displaced from the principal plane thereof.

6. The invention according to claim 3, wherein said pull tab is attached to said end panel by a rivet integrally formed therein, and a substantially U-shaped slit is formed in said pull tab embracing said rivet.

7. An improved easy-open end closure for use on a can or similar container comprising an end panel, a score line formed in said end panel and defining an opening flap therein, an auxiliary score line formed in said flap and defining a vent opening therein, and a pull tab attached to said end panel by a rivet, said pull tab having means for rupturing said score line and auxiliary rupturing means for rupturing said auxiliary score line, both of said score lines being rupturable consequent to displacement of said pull tab to open said closure, with said vent opening being opened prior to opening of said opening flap.

8. The invention according to claim 7, wherein said auxiliary rupturing means comprises a panelward projection on said pull tab, said projection being adapted to stress said end panel in the region o of said auxiliary score line consequent to said displacement of said pull tab.

* * * * *